United States Patent [19]

Stafford

[11] Patent Number: 5,025,264

[45] Date of Patent: Jun. 18, 1991

[54] CIRCULARLY POLARIZED ANTENNA WITH RESONANT APERTURE IN GROUND PLANE AND PROBE FEED

[75] Inventor: Gary P. Stafford, St. Albans, England

[73] Assignee: The Marconi Company Limited, England

[21] Appl. No.: 482,525

[22] Filed: Feb. 21, 1990

[30] Foreign Application Priority Data

Feb. 24, 1989 [GB] United Kingdom ..... 8904303

[51] Int. Cl.[5] ..... H01Q 1/38; H01Q 13/08; H01Q 13/18

[52] U.S. Cl. ..... 343/767; 343/770; 343/789

[58] Field of Search ..... 343/778, 741, 769, 767, 343/786, 789, 770, 846, 829

[56] References Cited

U.S. PATENT DOCUMENTS

| | | | |
|---|---|---|---|
| 3,568,206 | 3/1971 | Sisson et al. | 343/769 |
| 4,398,199 | 8/1983 | Makimoto et al. | 343/700 MS |
| 4,486,758 | 12/1984 | deRonde | 343/700 MS |
| 4,527,165 | 7/1985 | deRonde | 343/778 |
| 4,626,865 | 12/1986 | Rammos | 343/786 |
| 4,780,724 | 10/1988 | Sharma et al. | 343/700 MS |
| 4,847,626 | 7/1989 | Kahler et al. | 343/741 |

OTHER PUBLICATIONS

"Microstrip Antenna-Theory and Design", by James, Hall and Wood, Peter Peregrinus, 1981, Chapter 7.3.

*Primary Examiner*—Michael C. Wimer

*Attorney, Agent, or Firm*—Kirschstein, Ottinger, Israel & Schiffmiller

[57] ABSTRACT

A cavity-backed dual-slot antenna element for circular polarization having a single probe extending from the end of the feed line for the element and arranged to couple energy into the resonant slots. The probe lies in the plane of the feed line and has the form of an open circle having a circumference of approximately one wavelength at the operative frequency. The probe is constrained to lie within the boundary of the resonant slots as projected onto the plane of the feed line. The arrangement produces a circular polarization having a greater axial-ratio bandwidth than that of conventional antennas using two orthogonal probes or using a single probe feeding a resonant patch. An antenna comprising a flat array of the elements is suitable for use in DBS (Direct Broadcast by Satellite) TV reception. However, the probe itself is not limited to use in slot antennas and it has applications in other antennas or couplers for circular polarization.

14 Claims, 5 Drawing Sheets

CIRCULARLY POLARIZED ANTENNA WITH RESONANT APERTURE IN GROUND PLANE AND PROBE FEED

BACKGROUND OF THE INVENTION

1. Field of the Invention

This invention relates to a microwave antenna element, and in particular, although not exclusively, to an antenna element for use in cavity-backed dual-slot antennas for circular polarisation.

2. Description of Related Art

Conventionally, when it is required to produce circular polarisation from such antennas, either a pair of orthogonal probes is used in conjunction with each pair of slots, or a single probe is used to feed a form of resonant patch in the centre of the cavity. Two such antennas using orthogonal probes are described in U.S. Pat. Nos. 4,626,865 and 4,486,758. However, these types of arrangements are limited in their use because they inherently operate over a narrow axial-ratio bandwidth, typically 1%.

SUMMARY OF THE INVENTION

The present invention is concerned with producing circular polarisation, with an improved axial-ratio bandwidth, from a single probe.

According to the invention, an antenna element for circular polarisation comprises a planar conductive probe in the form of an open circle, a feed line lying in the plane of the probe and forming an extension of one end of the probe, and at least one ground plane parallel to, but displaced from, the probe plane.

The antenna element may comprise a microstripline board having a single ground plane, the ground plane having a resonant slot aligned with the probe so that the probe lies within the boundary of the slot as projected on the probe plane.

Alternatively, in a preferred embodiment of the invention, the antenna element has a stripline (Triplate—trademark) structure, wherein the probe and the feed line are provided on a dielectric sheet supported between two ground planes, the two ground planes each having a resonant slot, the two resonant slots being aligned with each other and with the probe so that the probe lies similarly within the boundary of the slots.

The stripline structure is preferably air-spaced.

The resonant slots are preferably circular.

The antenna element preferably has a resonant back cavity aligned with the two slots and the cavity may have a width dimension greater than that of the slots.

According to a preferred embodiment of the invention, an antenna comprises a two-dimensional array of antenna elements having the suspended stripline (Triplate—trademark) structure as aforesaid, wherein the probes of the elements and their associated feed lines are provided on a common dielectric sheet and the two ground planes are respectively continuous between adjacent elements, the probes of adjacent elements being arranged in sequential rotation and the elements in the array having a common resonant back cavity.

Alternatively, each element in the array may have an individual resonant back cavity aligned with its probe. Such individual cavities may be formed in a single reflecting back structure.

In an antenna according to the invention having the aforesaid array structure, the probes are preferably inter-connected by feed lines lying outside the projected boundaries of the slots in the two ground planes.

According to the invention, an antenna element for circular polarisation comprises a planar conductive probe and a feed line lying in the plane of the probe and forming an extension of one end of the probe, the probe substantially surrounding an axis normal to the probe plane, the element further comprising a ground plane parallel to, but displaced from, the probe plane. The ground plane preferably includes a resonant slot associated with the probe, the probe lying within the boundary of the slot as projected on the probe plane.

BRIEF DESCRIPTION OF THE DRAWINGS

In order that the invention may be more readily understood, embodiments thereof will now be described, by way of example only, with reference to the accompanying drawings, in which.

DETAILED DESCRIPTION OF THE PREFERRED EMBODIMENTS

Figure 1:
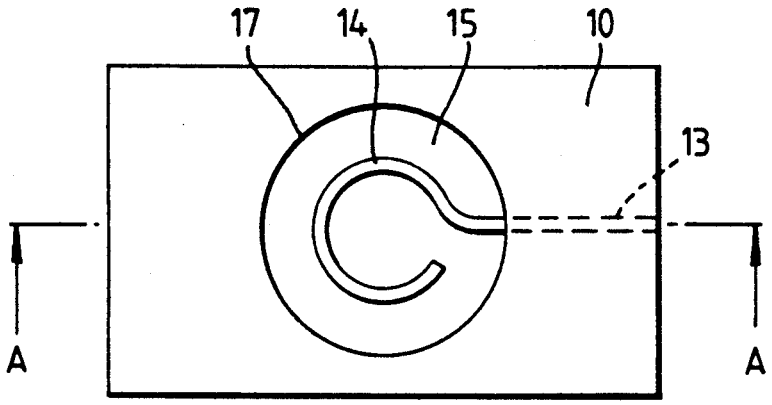
FIG. 1 is a plan view of an antenna element according to the invention.
Figure 2:
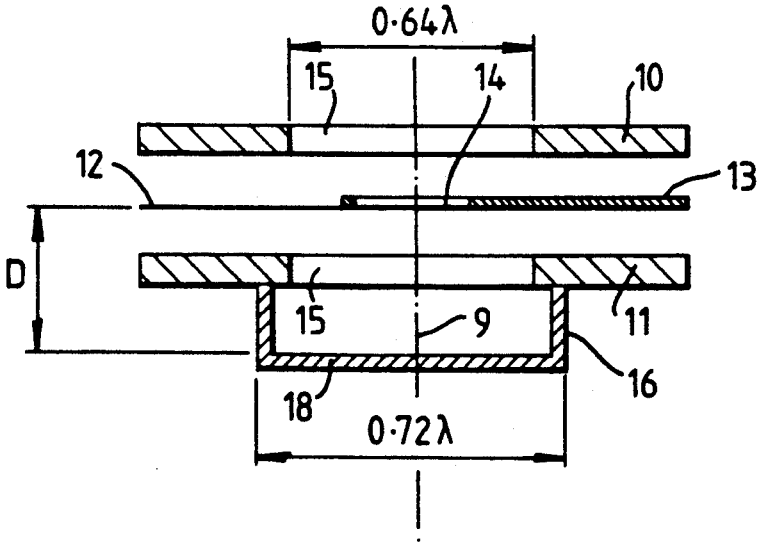
FIG. 2 is a section taken on the line A—A of through FIG. 1.

Referring to FIG. 1 and FIG. 2 of the accompanying drawings, it can be seen that the antenna element comprises a conventional Tri-plate (trademark), i.e. a suspended stripline structure having an upper ground plane sheet 10 and a lower ground plane sheet 11 mounted on either side of a dielectric sheet 12. The two ground plane sheets 10,11 are respectively separated from the dielectric sheet 12 by means of a number of insulating spacers (not shown) to define two air layers therebetween. The dielectric sheet 12 carries a printed copper feed line 13 having a co-planar probe 14 formed at its end. The probe 14 has the form of an open circle in the plane of the sheet 12 and centered on an axis 9 normal to the sheet 12 (see FIG. 2), so that the probe meets the basic requirement of substantially surrounding the axis 9. Each of the ground planes 10, 11 has a resonant 'slot' 15 (actually in the form of a circular aperture), the two slots providing the "dual-slot" feature known in antennas of this type. The slots 15 are aligned with one another and with the circular planar probe 14 between them, so that energy supplied to the probe 14 by the feed line 13 is coupled to the slots 15. The resonant slots 15 have a diameter of 0.64λ where λ is the operational wavelength of the antenna, as is conventional in antennas of this type.

The antenna further comprises a resonant quarter-wave cavity 16 of a suitable metal, which is mounted beneath the aligned slots 15 and has a diameter of 0.72λ, i.e. slightly greater than the diameter of the slots 15.

The spacing D of the probe 14 from the back wall 18 of the cavity 16 is chosen for resonance at the operative frequency of the antenna.

As shown in FIG. 1, the probe 14 is arranged to lie within the boundary 17 of the slots 15 as projected onto the dielectric sheet 12. The feed line 13, as it reaches the projected boundary 17, extends to form the probe 14 within the boundary 17. Thus, the probe 14 follows the boundary 17 in an incomplete ring and at a radius necessary to prescribe a circle having a circumference of approximately one wavelength, i.e. a circle having a resonant dimension. There is a constant separation, measured radially with respect to the boundary 17, between the probe 14 and the boundary 17. In order to avoid the end of the probe 14 short-circuiting with the end of the feed line 13, the probe 14 is terminated at a distance which is approximately three line widths from the end of feed line 13. The width of the feed line 13 is chosen to provide the desired input impedance for the antenna element. The direction of rotation of the polarising vector of a signal transmitted by the antenna element, i.e. whether a left-hand or right-hand circular polarisation is generated, is determined by the direction of the probe 14 in the plane of the sheet 12 about the axis 9.

Figure 3:
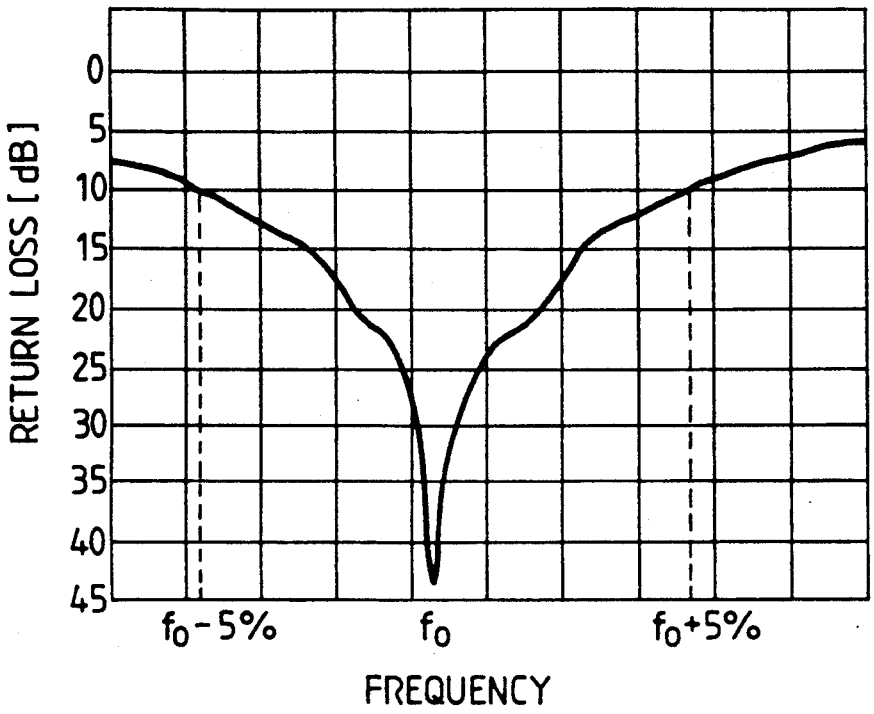
FIG. 3 is a graph showing the return-loss of the antenna element of FIG. 1.
Figure 5:
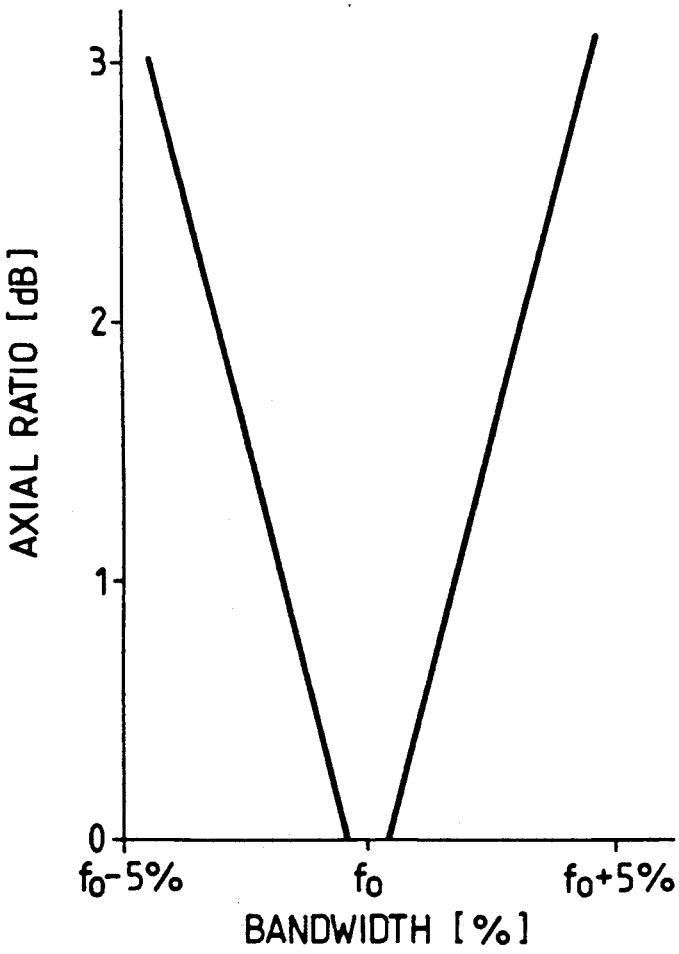
FIG. 5 is a plot of the axial-ratio bandwidth of the antenna element of FIG. 1.
Figure 4:
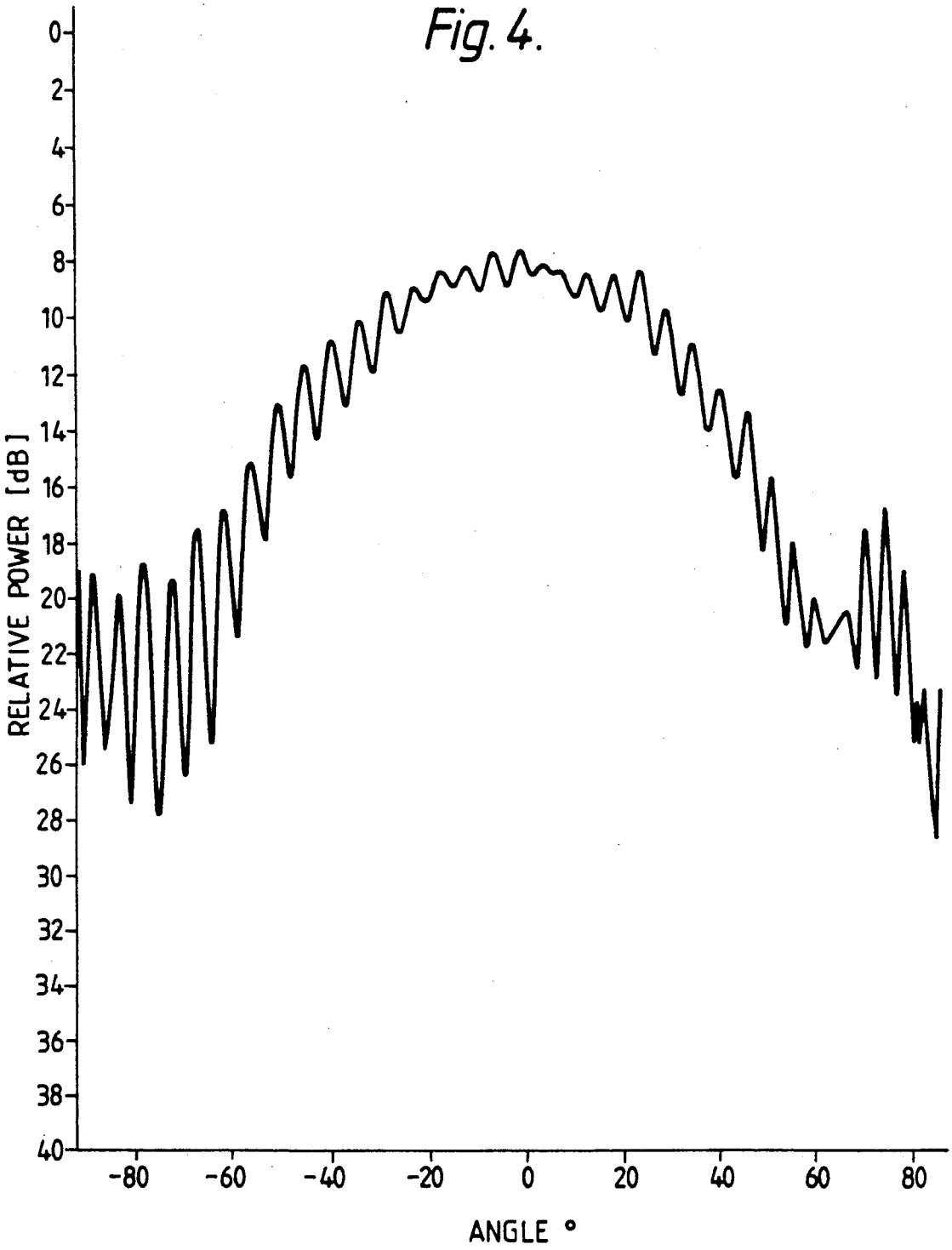
FIG. 4 is a plot of the axial-ratio of the antenna element of FIG. 1 over a 180° azimuth range.

FIG. 3 of the drawings shows the return loss of an antenna element of the kind just described with reference to FIGS. 1 and 2. It is seen that the return loss is approximately −10dB within a frequency band extending to ±5% the centre frequency $f_o$. FIG. 4 is plot of the axial-ratio of the antenna over 180° azimuth range. The axial-ratio is a measure of the purity of the circular polarisation produced. FIG. 5 is a plot of the axial-ratio bandwidth of the antenna which is in the region of 10%.

In the embodiment of the invention described with reference to FIGS. 1 and 2, the suspended stripline structure (10,11,12) is shown to be the air-spaced type. Thus the feed line 13 and the probe 14 represent a suspended stripline, with air serving as the dielectric between the sheet 12 and the ground planes 10,11. However, the invention is not limited to antennas having an air-spaced feed network and other dielectric materials may be used according to requirements. Thus, for example, two layers of dielectric material may be used to support and space the sheet 12 between the two ground plane sheets 10,11.

Figure 6:
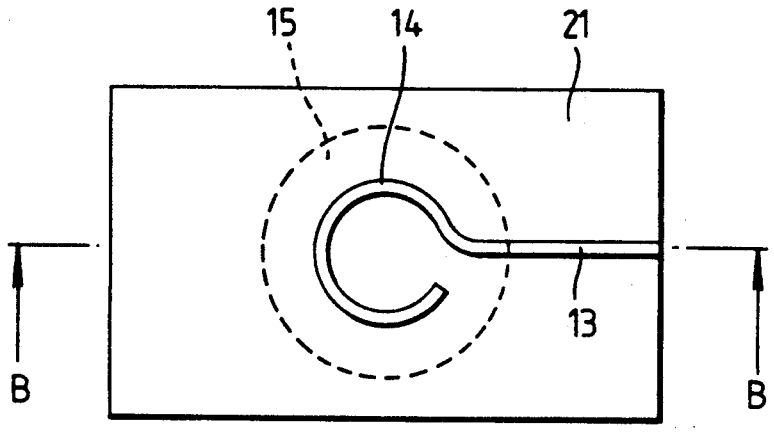
FIG. 6 is a plan view of an alternative construction of an antenna element according to the invention.
Figure 7:
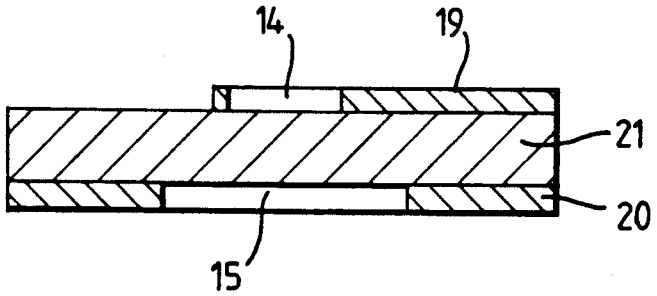
FIG. 7 is a section taken on the line B—B of through FIG. 6.

In an alternative embodiment of the invention, in place of the suspended stripline structure (10,11,12), the antenna may be constructed in microstripline form on a double-sided circuit board as shown in FIGS. 6 and 7. Here, the feed line 13 and probe 14 are etched from one outer conductive layer 19, the other outer conductive layer 20 providing a single ground plane for the antenna. The two outer layers 19,20 sandwich a dielectric substrate 21 as shown in FIG. 7, which is clearly not drawn to scale. Again, the ground plane 20 may have a resonant slot 15, as shown, aligned with the probe 14 as previously described. However, in this embodiment of the invention the provision of a resonant slot is not essential. Thus, in its most basic form the antenna comprises essentially a feed line, a probe and an underlying ground plane. A second ground plane (not shown), separate from the microstripline board, may be provided adjacent the probe 14 and feed line 13 to form a dual-slot antenna of similar form to that shown in FIG. 2. Similarly, a resonant quarter-wave back cavity may also be incorporated, although this has not been shown in FIGS. 6 and 7.

Figure 8:
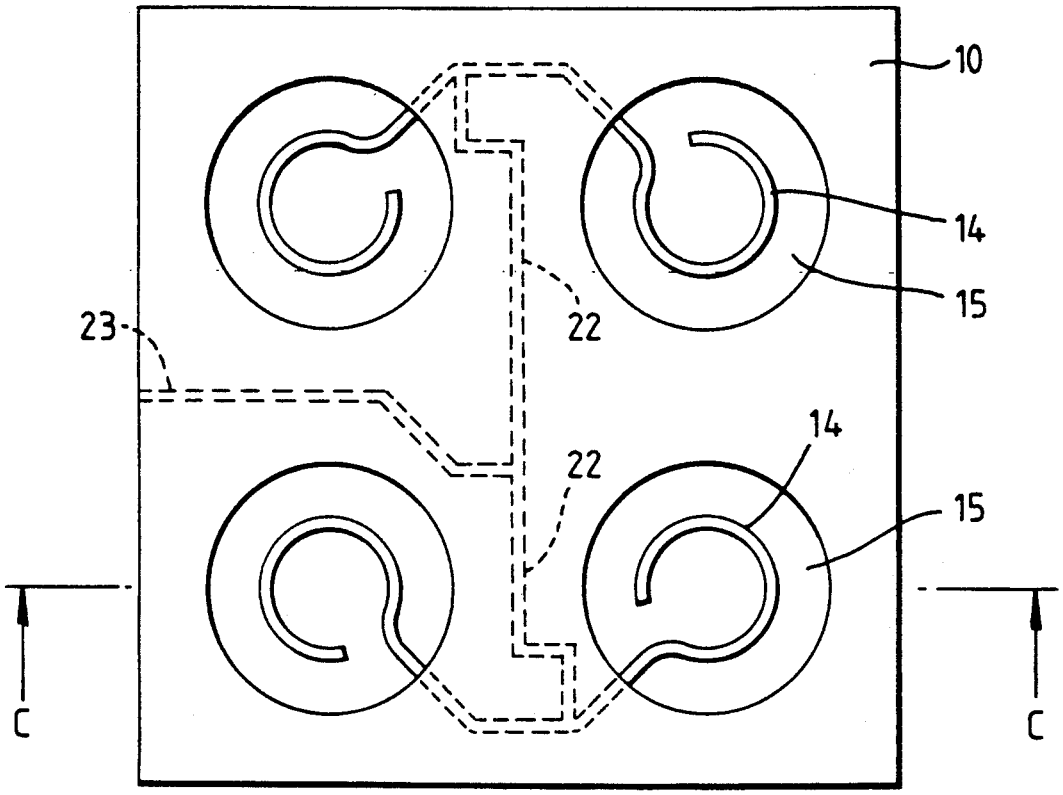
FIG. 8 is a plan view of a four-element antenna according to the invention.
Figure 9:
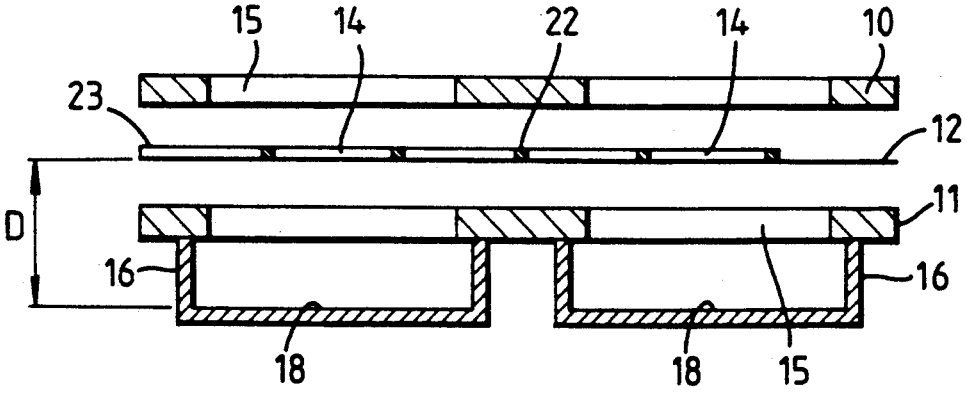
FIG. 9 is a section taken on the line C—C of through FIG. 8.

Referring now to FIGS. 8 and 9, there is shown a simple array of four antenna elements of the type already described with reference to FIGS. 1 and 2. A practically useful antenna in accordance with the invention will generally comprise an array of this type, but having a much larger number (say, one hundred or more) of elements. The array of four elements shown in FIGS. 8 and 9 merely serves to illustrate how the individual elements are arranged with respect to one another. Components which are common to FIGS. 1,2,8 and 9 have been given the same reference numerals. It can be seen from FIG. 9 that the upper and lower ground planes 10, 11 are respectively continuous between adjacent antenna elements, so that they each comprise a single layer having an array of the resonant slots 15. Similarly, the dielectric sheet 12 is continuous throughout the plane of the antenna and a network of feed conductors 22 connects the individual probes 14 to a common feed line 23 for the antenna. The feed line 23 is terminated at a connector on one edge of the antenna for connection to a coaxial cable or other transmission line. Adjacent probes 14 are shown oriented according to the conventional sequential rotation technique to minimise the axial-ratio of the array. Thus, it can be seen from FIG. 8 that adjacent probes 14 are arranged so that their feed lines are mutually orthogonal. However, the probes 14 may be arranged in any orientation to suit the particular requirement.

Although in FIG. 9 the array comprises elements having individual back cavities, each associated with a corresponding probe 14 and pair of slots 15, it will be appreciated that a common cavity for all the elements in the array, or for groups of the elements, may alternatively be used, as is known for antennas of this type. The individual cavities may be formed in a single, suitably pressed, metallic back structure extending in the plane of the antenna. It should be noted, however, that in all embodiments of the invention, the resonant back cavity is not an essential feature. It may be omitted in some configurations, although this may reduce the gain that can be achieved.

Further, it will be appreciated that, in the case of slot antennas, the invention is not limited to the use of circular slots. Other forms of resonant aperture may be used, provided that the probe is still constrained to lie within the projected boundary of the slot on the plane of the probe. For instance, the use of square or rectangular slots is known in the art (see, for example, U.S. Pat. No. 4,527,165).

It will also be appreciated that, as for any antenna, reciprocity applies, so that the antenna may be used either for transmission or reception of circularly-polarised signals.

I claim:

1. An antenna element for circularly polarized signals, comprising:

(a) a circular probe in the form of an incomplete conductive ring, said probe lying in a probe plane;

(b) a feed conductor connected to said probe;

(c) a ground plane spaced from, but parallel to, said probe plane, said ground plane having a resonant slot in the form of a circular aperture, said aperture being co-axial with, and of greater diameter than, said circular probe; and (d) said probe having a circumference of length which is resonant at the operating frequency of the antenna element.

2. An antenna element according to claim 1, wherein said probe and said feed conductor are formed as stripline on a microstripline board.

3. An antenna element according to claim 2, wherein said ground plane is formed as a conductive sheet on the face of said board opposite to said probe and said feed conductor.

4. An antenna element according to claim 1, wherein said feed conductor is connected to an end of said circular probe and forms a radial extension thereof.

5. An antenna element according to claim 1, said ground plane being the first of first and second ground planes, the second ground plane being disposed parallel to said probe plane but on the side of said probe plane remote from said first ground plane, and said second ground plane having a resonant slot in the form of a circular aperture coaxial with, and of greater diameter than, said circular probe.

6. An antenna element according to claim 5, wherein said first and second ground planes are spaced from said probe plane by air.

7. An antenna element according to claim 1, further comprising a resonant back cavity mounted in contact with said ground plane on the side of said ground plane remote from said probe, the aperture in said ground plane exposing said probe to said cavity.

8. An antenna element according to claim 7, wherein said cavity is coaxial with said circular aperture.

9. An antenna element according to claim 8, wherein said cavity is circular and of diameter greater than that of said circular aperture.

10. An antenna element for circularly polarized signals, comprising:

(a) a probe lying in a probe plane;

(b) an axis normal to said probe plane;

(c) a feed conductor lying in said probe plane and connected to said probe;

and (d) a ground plane spaced from, but parallel to, said probe plane;

(e) said ground plane having a resonant aperture;

(f) said probe substantially surrounding said axis and lying within a boundary formed by a projection of said resonant aperture.

11. An antenna for circularly polarized signals, comprising:

(A) a plurality of antenna elements arranged in a planar array, each antenna including (a) a circular probe in the form of an incomplete conductive ring, said probe lying in a probe plane;

(b) a feed conductor connected to said probe;

(c) a ground plane spaced from, but parallel to, said probe plane, said ground plane having a resonant slot in the form of a circular aperture co-axial with, and of greater diameter than, said circular probe; and (d) said probe having a circumference of length which is resonant at the operating frequency of the antenna element;

(B) said ground plane extending continuously between adjacent antenna elements in said array; and (C) said feed conductors of said plurality of antenna elements being coupled together to provide a common feed line for the antenna.

12. An antenna for circularly polarized signals, comprising:

(A) a plurality of antenna elements arranged in a planar array, each antenna element including (a) a circular probe in the form of an incomplete conductive ring, said probe lying in a probe plane;

(b) a feed conductor connected to said probe;

(c) first and second ground planes disposed on respective opposite sides of said probe plane, and spaced from, but parallel to, said probe plane, each of said first and second ground planes having a resonant slot in the form of a circular aperture co-axial with, and of greater diameter than, said circular probe; and (d) said probe having a circumference of length which is resonant at the operating frequency of the antenna;

(B) said first and second ground planes respectively extending continuously between adjacent antenna elements in said array; and (C) said feed conductor of said plurality of antenna elements being coupled together to provide a common feed line for the antenna.

13. An antenna according to claim 12, each said antenna element further comprising a resonant back cavity mounted in contact with one of said first and second ground planes on the side of said one ground plane remote from said probe, the aperture in said one ground plane exposing said probe to said cavity.

14. An antenna according to claim 13, wherein said cavity is circular and of greater diameter than that of said circular aperture.

* * * * *